US010830226B2

(12) United States Patent
Teshima et al.

(10) Patent No.: US 10,830,226 B2
(45) Date of Patent: Nov. 10, 2020

(54) DIAPHRAGM PUMP WITH A RAIL TO RESTRICT ROTATION AND A PISTON CAVITY TO ENGAGE WITH A GUIDING MEMBER AT THE END OF THE SUCTION STROKE

(71) Applicant: Nippon Pillar Packing Co., Ltd., Osaka (JP)

(72) Inventors: Kazukiyo Teshima, Osaka (JP); Motoaki Naruo, Osaka (JP)

(73) Assignee: NIPPON PILLAR PACKING CO., LTD., Osaka (JP)

( * ) Notice: Subject to any disclaimer, the term of this patent is extended or adjusted under 35 U.S.C. 154(b) by 295 days.

(21) Appl. No.: 15/037,216

(22) PCT Filed: Oct. 31, 2014

(86) PCT No.: PCT/JP2014/079122
§ 371 (c)(1),
(2) Date: May 17, 2016

(87) PCT Pub. No.: WO2015/076089
PCT Pub. Date: May 28, 2015

(65) Prior Publication Data

US 2016/0273527 A1 Sep. 22, 2016

(30) Foreign Application Priority Data

Nov. 20, 2013 (JP) ..... 2013-240115
Nov. 20, 2013 (JP) ..... 2013-240116

(51) Int. Cl.
*F04B 43/02* (2006.01)
*F04B 53/14* (2006.01)
(Continued)

(52) U.S. Cl.
CPC ..... *F04B 43/02* (2013.01); *F04B 39/044* (2013.01); *F04B 53/10* (2013.01); *F04B 53/14* (2013.01); *F04B 53/146* (2013.01)

(58) Field of Classification Search
CPC ..... F15B 2015/1495; F15B 15/063
See application file for complete search history.

(56) References Cited

U.S. PATENT DOCUMENTS 1,552,068 A * 9/1925 Lee ..... F04B 9/02 417/415
3,250,225 A * 5/1966 Taplin ..... F04B 27/02 417/413.1
(Continued)

FOREIGN PATENT DOCUMENTS

EP 0 415 536 A1 3/1991
JP 07-130627 5/1995
(Continued)

OTHER PUBLICATIONS

European Search Report dated Jul. 10, 2017, 8 pages.
(Continued)

*Primary Examiner* — Peter J Bertheaud
*Assistant Examiner* — Geoffrey S Lee
(74) *Attorney, Agent, or Firm* — Rankin, Hill & Clark LLP

(57) ABSTRACT

A diaphragm pump has: a housing; a piston; a shaft; a rolling diaphragm, which is configured so that a lid portion reciprocally moves integrally with the piston; a driving device, which can convert rotational movement of a motor section to linear movement, and output the linear movement from an output axle to the shaft; a guiding member; and a restricting mechanism. The guiding member is placed on another axial end side of an interior of the housing with respect to the piston, attached to the housing, and able to guide the shaft movably in the axial direction. The restricting member is
(Continued)

disposed in the housing and between the guiding member and the shaft, and able to restrict rotation of the shaft about the axis while allowing reciprocal movement in the axial direction.

15 Claims, 9 Drawing Sheets

(51) Int. Cl.
*F04B 39/04* (2006.01)
*F04B 53/10* (2006.01)

(56) References Cited

U.S. PATENT DOCUMENTS 7,134,850 B2 * 11/2006 Teshima ..... F04B 43/08 417/398
7,293,967 B2 * 11/2007 Fukano ..... F04B 9/02 417/413.1
7,537,437 B2 * 5/2009 Muramatsu ..... F04B 17/042 417/356
9,599,222 B2 * 3/2017 Teshima ..... F16J 3/02
10,480,547 B2 * 11/2019 Starkey ..... F04B 49/20
2004/0170511 A1 * 9/2004 Teshima ..... F04B 43/08 417/394
2008/0120977 A1 * 5/2008 Safran ..... F03G 7/06 60/531
2008/0260549 A1 * 10/2008 Yajima ..... F04B 43/107 417/375
2009/0241767 A1 * 10/2009 Muramatsu ..... F15B 15/10 92/96
2009/0321201 A1 * 12/2009 Sakuta ..... F16F 9/052 188/290
2015/0300491 A1 * 10/2015 Teshima ..... F04B 43/0054 92/48
2019/0162210 A1 * 5/2019 Starkey ..... F04B 49/06

FOREIGN PATENT DOCUMENTS

JP H10-47234 2/1998
JP 2006-132502 5/2006
JP 2007-023935 2/2007
JP 2010-144616 7/2010
JP 5248266 7/2013
TW 2008-19632 A 5/2008

OTHER PUBLICATIONS

International Search Report, dated Jan. 27, 2015 (Jan. 27, 2015).
English abstract of Korean Office Action dated Apr. 30, 2018, 3 pages.
Taiwanese Office Action dated Oct. 29, 2018, 5 pages.

* cited by examiner (a)

(b)

(a)

(b)

DIAPHRAGM PUMP WITH A RAIL TO RESTRICT ROTATION AND A PISTON CAVITY TO ENGAGE WITH A GUIDING MEMBER AT THE END OF THE SUCTION STROKE

TECHNICAL FIELD

The present invention relates to a diaphragm pump including a rolling diaphragm.

BACKGROUND ART

As a conventional diaphragm pump which is used for supplying a liquid such as a chemical liquid in a process of producing a semiconductor, a liquid crystal, an organic EL, a solar cell, an LED, or the like, for example, a diaphragm pump disclosed in Patent Literature 1 has been known.

A diaphragm pump of this kind includes: a cylinder (housing); a piston which is accommodated in the cylinder so as to be reciprocally movable in the axial direction of the cylinder; a rolling diaphragm which is configured so as to operate in accordance with the reciprocal movement of the piston; and a linear actuator (driving device) having an output axle configured by a screw shaft which is connected to the piston so as to play roles of a motor section and a piston rod.

The linear actuator is attached to the cylinder, and configured so that, in order to cause the piston to reciprocally move in the axial direction, the rotational movement of the motor section is converted to linear movement, and then output from the output axle to the piston. The output axle is placed coaxially with the piston, coupled thereto by means of thread coupling, and configured so as to be reciprocally movable integrally with the piston in the axial direction.

In the diaphragm pump, however, the output axle of the linear actuator is not supported by any member during a period from a timing when the opposing surface which is on the body of the linear actuator, and which faces the interior of the cylinder is inserted into the cylinder, to that when the output axle is thread-coupled to the piston, and is not also guided to reciprocally move in the axial direction. The output axle is configured simply so as to be hung between the body of the linear actuator and the piston.

During the reciprocal movement of the piston in accordance with the output of the output axle, therefore, the piston rattles in a radial direction (direction perpendicular to or intersecting with the axial direction) of the cylinder, twisting, distortion, of the like of the rolling diaphragm is caused, and there is a possibility that the rolling diaphragm does not normally operate (deform). Namely, there is a case where the quantitativeness of the liquid transportation amount of the diaphragm pump is lowered.

In the diaphragm pump, moreover, the below-described rotation locking means which allows the reciprocal movement of the piston, and which limits the rotation is disposed between the piston that is thread-coupled to the output axle of the linear actuator, and the cylinder. Therefore, the piston further rattles, and the quantitativeness of the liquid transportation amount of the diaphragm pump is easily lowered.

Namely, the above-described rotation locking means is configured by a long hole which is formed in the sidewall of the cylinder in the axial direction, and an engagement pin which is radially projected from the outer circumferential surface of the piston so as to be able to pass through the long hole. Then, the engagement pin is passed through the long hole so that a projection end portion of the pin is located outside the cylinder, and the engagement pin is enabled to reciprocally move integrally with the piston while being guided by the long hole.

In the rotation locking means, therefore, the engagement pin and the long hole are loosely fitted to each other. During the reciprocal movement of the piston, therefore, the piston which receives the rotation input from the output axle rattles in the circumferential direction of the cylinder, the rolling diaphragm is caused to twist or distort, and there is a possibility that the rolling diaphragm does not normally operate (deform). As a result, the quantitativeness of the liquid transportation amount of the diaphragm pump is easily lowered.

PRIOR ART LITERATURE

Patent Literature

Patent Literature 1: Japanese Patent Application Laid-Open No. 2007-23935

SUMMARY OF THE INVENTION

Problems to be Solved by the Invention

The invention has been conducted in view of the above-discussed circumstances. It is an object of the invention to provide a diaphragm pump in which the lowering of the quantitativeness of the liquid transportation amount caused by the operation of a rolling diaphragm can be effectively suppressed.

Means for Solving the Problems

The invention of claim 1 is a diaphragm pump including:

a housing;

a piston which is placed in the housing to be coaxial with the housing, and which is disposed to be reciprocally movable in an axial direction of the housing;

a shaft which is configured to be moved in conjunction with the piston in a state where one axial end side is in contact with the piston, a rolling diaphragm having: a lid portion which is placed on the one axial end side of the piston; an open-end portion which is attached to the housing; and a folded portion which is placed between the lid portion and the open-end portion, the lid portion being reciprocally movable integrally with the piston with respect to the open-end portion which is positionally fixed by the housing;

a pump chamber which is defined by the rolling diaphragm on a one axial end side of an interior of the housing with respect to the rolling diaphragm, a volume of an interior of the chamber being variable;

a driving device having: a motor section; and an output axle which is placed coaxially with the shaft, and which is coupled to another axial end side of the shaft, the driving device being attached to another axial end side of the housing, the driving device being able to, in order to cause the piston to reciprocally move in the axial direction through the shaft, convert rotational movement of the motor section to linear movement, and output the linear movement from the output axle to the shaft;

a guiding member which is placed on the other axial end side of the interior of the housing with respect to the piston, which is attached to the housing, and which is able to guide the shaft in a manner to be movable in the axial direction; and a restricting mechanism which is disposed in the housing and between the guiding member and the shaft, and which is able to restrict rotation of the shaft about the axis while allowing reciprocal movement in the axial direction.

According to the configuration, the shaft is reciprocally movable while being guided by the guiding member. During the reciprocal movement of the shaft, therefore, the shaft and the piston which is moved in conjunction with the shaft are caused to hardly rattle in a radial direction (direction perpendicular to or intersecting with the axial direction) of the housing, and the rolling diaphragm is easily enabled to normally operate (deform) without causing the rolling diaphragm to twist or distort. Therefore, the lowering of the quantitativeness of the liquid transportation amount caused by the operation of the rolling diaphragm can be effectively suppressed.

The invention of claim 2 has a configuration where, in the diaphragm pump of claim 1, the restricting mechanism is configured by a ball spline having: a spline shaft which is formed by the shaft; and a cylindrical member which is fixed to the guiding member, and which is able to slidably guide the spline shaft in the axial direction while supporting the spline shaft in a relatively non-rotatable manner.

According to the configuration, during the reciprocal movement of the shaft, the shaft and the piston are caused to further hardly rattle in a radial direction of the housing. Therefore, the lowering of the quantitativeness of the liquid transportation amount can be more effectively suppressed.

The invention of claim 3 has a configuration where, in the diaphragm pump of claim 2, the diaphragm pump includes a coupling member which is configured to couple together the shaft and the output axle by clamping another axial end portion of the shaft, and clamping a one axial end portion of the output axle.

According to the configuration, the shaft and the output axle of the driving device can be easily assembled to and separated from each other. Therefore, maintenance of the diaphragm pump can be simplified.

The invention of claim 4 has a configuration where, in the diaphragm pump of any one of claims 1 to 3, the piston has a concave portion which opens toward the lid portion of the rolling diaphragm, and the rolling diaphragm has a projection which is fittable into the concave portion, and is attached to the piston in a state where the projection is fitted into the concave portion of the piston.

According to the configuration, in the case where a shock is applied to a liquid in the pump chamber in, for example, a suction step of the diaphragm pump, it is possible to cause the rolling diaphragm to hardly deform with respect to the piston. The axial alignment between the rolling diaphragm and the piston can be performed by fitting between the projection and the concave portion, and the lowering of the quantitativeness of the fluid transportation amount can be more effectively suppressed.

The invention of claim 5 has a configuration where, in the diaphragm pump of claim 1, the restricting mechanism is disposed on the other axial side of the guiding member in the housing.

The invention of claim 6 has a configuration where, in the diaphragm pump of claim 5, the restricting mechanism is configured by a linear guide having: a rail-like guiding member which is disposed in the housing to extend in the axial direction; and a sliding member which is fixed to the shaft, which is attached to the guiding member, and which is relatively movable with respect to the guiding member.

According to the configuration, during the reciprocal movement of the shaft, the shaft and the piston are caused to further hardly rattle in a radial direction (direction perpendicular to or intersecting with the axial direction) of the housing. Therefore, the lowering of the quantitativeness of the liquid transportation amount can be more effectively suppressed.

The invention of claim 7 has a configuration where, in the diaphragm pump of claim 6, the sliding member is configured to couple the shaft and the output axle with each other by clamping the other axial end portion of the shaft, and clamping the one axial end portion of the output axle.

According to the configuration, the shaft and the output axle of the driving device can be easily assembled to and separated from each other. Therefore, maintenance of the diaphragm pump can be simplified. Moreover, the shaft and the output axle can be axially moved while maintaining the stable connection state.

The invention of claim 8 has a configuration where, in the diaphragm pump of claim 6, the piston has a fitting concave portion into which the one axial end portion of the shaft is fittable, and is configured to be movable in conjunction with the shaft, by fitting the one axial end portion of the shaft into the fitting concave portion while being separably contacted to each other.

According to the configuration, the piston and the shaft can be easily assembled to and separated from each other. Therefore, maintenance of the diaphragm pump can be simplified. Moreover, deformation of the piston caused by the coupling of the piston and the shaft can be prevented from occurring.

The invention of claim 9 has a configuration where, in the diaphragm pump of claim 6, the piston has a concave portion which opens toward the lid portion of the rolling diaphragm, and the rolling diaphragm has a projection which is fittable into the concave portion, and is attached to the piston in a state where the projection is fitted into the concave portion of the piston.

According to the configuration, in the case where a shock is applied to a liquid in the pump chamber in, for example, a suction step of the diaphragm pump, it is possible to cause the rolling diaphragm to hardly deform with respect to the piston. The axial alignment between the rolling diaphragm and the piston can be performed by fitting between the projection and the concave portion, and the lowering of the quantitativeness of the fluid transportation amount can be more effectively suppressed.

Effects of the Invention

According to the invention, it is possible to provide a diaphragm pump in which the lowering of the quantitativeness of the liquid transportation amount caused by the operation of a rolling diaphragm can be effectively suppressed.

BEST MODE FOR CARRYING OUT THE INVENTION

A first embodiment of the invention will be described with reference to the drawings.

Figure 1:
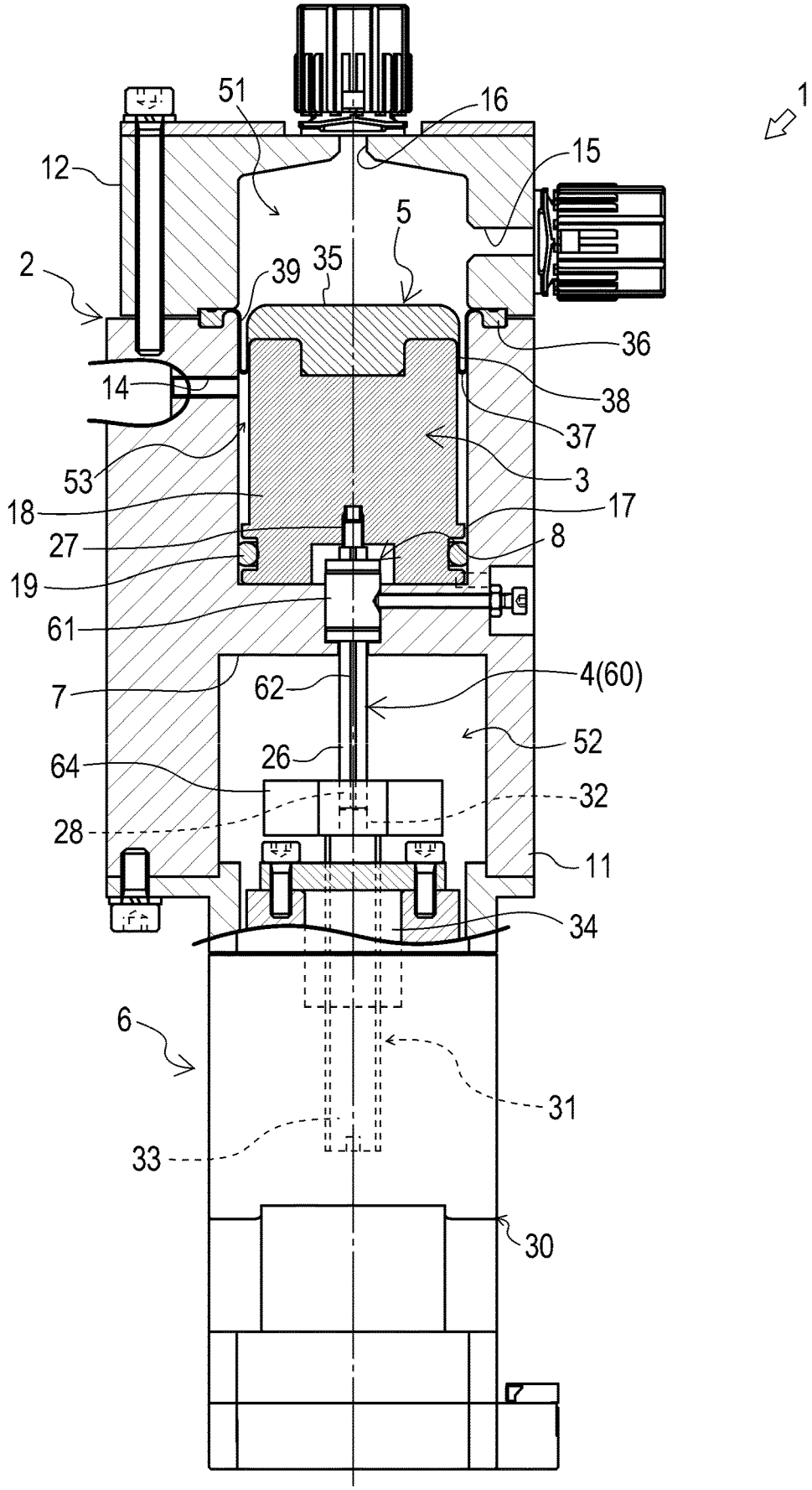
FIG. 1 is a side sectional view of a diaphragm pump of a first embodiment of the invention.
Figure 2:
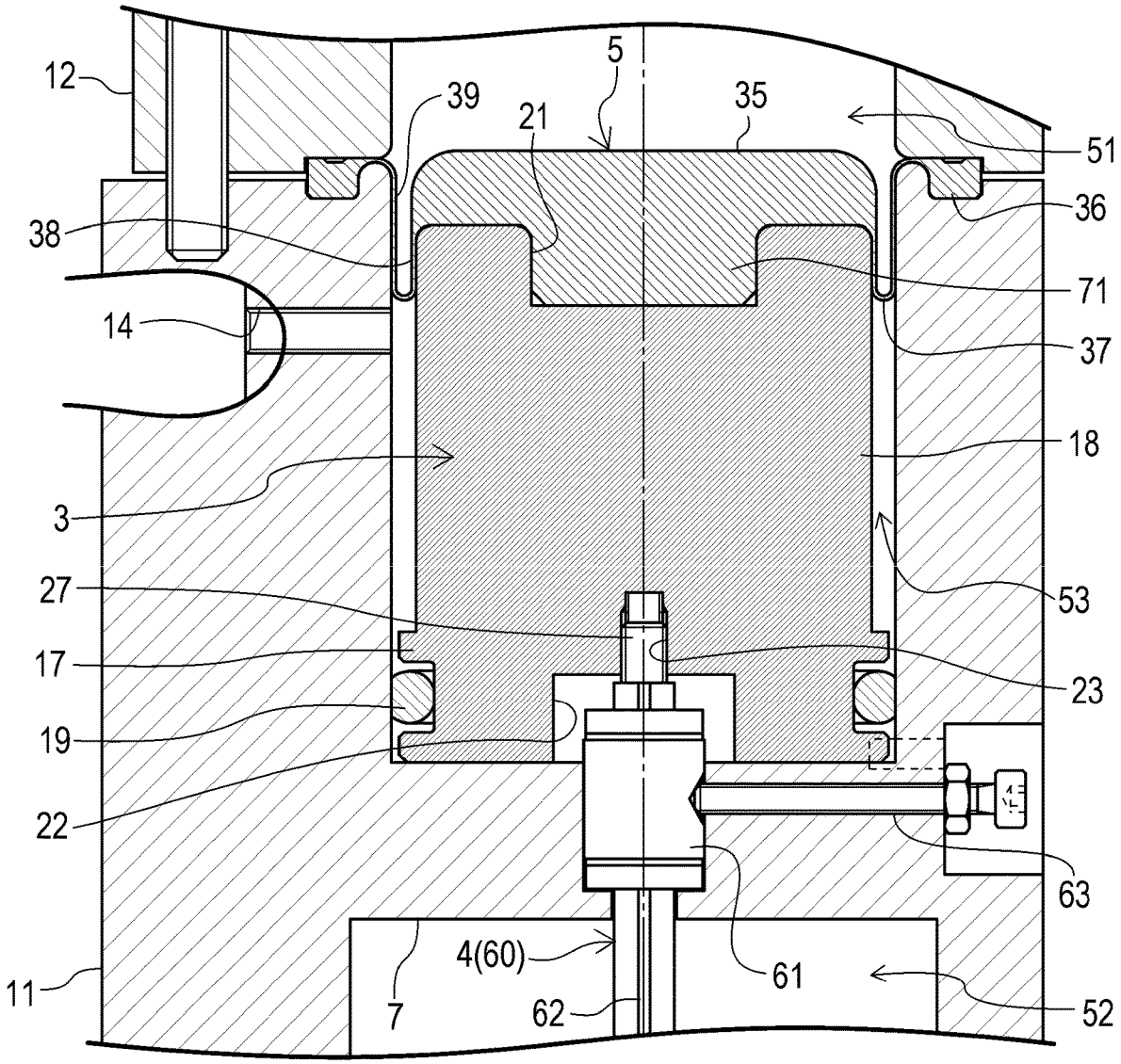
FIG. 2 is a partial enlarged side sectional view of the diaphragm pump of the first embodiment of the invention.

FIG. 1 is a side sectional view of a diaphragm pump 1 of the first embodiment of the invention. FIG. 2 is a partial enlarged side sectional view of the diaphragm pump 1.

As shown in FIGS. 1 and 2, the diaphragm pump 1 includes a housing 2, a piston 3, a shaft 4, a rolling diaphragm 5, a driving device 6, a guiding member 7, and a restricting mechanism 8. In the embodiment, the diaphragm pump 1 is placed so that its longitudinal direction (axial direction) extends in the vertical direction.

In the embodiment, the housing 2 has a cylinder 11 and a pump head 12. The cylinder 11 is formed into a cylindrical shape, and placed so that the axial direction extends in the vertical direction. For example, the cylinder 11 is made of stainless steel such as SUS304. In the cylinder 11, an air vent 14 which passes through the cylinder in a direction perpendicular to or intersecting with the axial direction is disposed. The air vent 14 is connected to a decompression device such as a vacuum pump or an aspirator.

The pump head 12 is formed into a lidded cylindrical shape, and attached to the one axial end side (upper side) of the cylinder 11 so as to close the opening. The pump head 12 has an inner diameter which is substantially equal to that of the cylinder 11, and constitutes together with the cylinder 11 an accommodating space which can accommodate the piston 3. The pump head 12 is made of a fluorine resin such as PTFE (polytetrafluoroethylene).

In a circumferential wall portion of the pump head 12, a suction port 15 which passes through the circumferential wall portion in a direction perpendicular to or intersecting with the axial direction is disposed. The suction port 15 is connected to a liquid tank (not shown) which stores a liquid such as a chemical liquid, through a suction check valve. The suction check valve is configured so as to allow the liquid to flow from the liquid tank toward the suction port 15, and block a liquid flow in the opposite direction.

In a lid portion of the pump head 12, an ejection port 16 which passes through the lid portion in the axial direction is disposed so as to be located in a middle portion (axial portion) of the lid portion. The ejection port 16 is connected to a liquid supplying section (not shown) through an ejection check valve. The ejection check valve is configured so as to allow the liquid to flow from the ejection port 16 to the liquid supplying section, and block a liquid flow in the opposite direction.

In the housing 2, the piston 3 is placed coaxially with the housing 2, and disposed so as to be reciprocally movable in the axial direction (vertical direction) of the housing 2. In the embodiment, the piston 3 is formed into a columnar shape having a diameter which is smaller then the inner diameter of the housing 2 (the cylinder 11 and the pump head 12), and placed so that the outer circumferential surface is opposed to the inner circumferential surface of the housing 2 (the cylinder 11 or the pump head 12). The piston 3 is made of, for example, an aluminum alloy.

The piston 3 has a large-diameter portion 17 which butts against or substantially butts against the inner circumferential surface of the housing 2, in the other axial end side (lower side), and a small-diameter portion 18 which forms a predetermined gap with respect to the inner circumferential surface of the housing 2, in the one axial end side (upper side), and can guide the outer circumferential surface of the large-diameter portion 17 in the axial direction along the inner circumferential surface of the housing 2. A packing 19 such as an O-ring is disposed between the outer circumferential surface of the large-diameter portion 17 of the piston 3 and the inner circumferential surface of the housing 2. The packing 19 is made of, for example, a rubber material such as fluorine rubber.

As shown in FIG. 2, the piston 3 has a first concave portion 21 which opens toward the one axial end side (upper side), and a second concave portion 22 which opens toward the other axial end side (lower side). The first concave portion 21 and the second concave portion 22 are disposed in the axial portion of the piston 3, and placed coaxially with each other. Here, the first concave portion 21 and the second concave portion 22 do not communicate with each other.

The piston 3 further has a screw hole 23 in which an internal thread is formed. The screw hole 23 is placed between the first concave portion 21 and the second concave portion 22, and in the axial portion of the piston 3, and placed coaxially with the second concave portion 22. The screw hole 23 is smaller in diameter than the second concave portion 22, and opens toward the other axial end side (lower side) of the piston 3 so as to face the interior of the second concave portion 22.

The shaft 4 is configured so as to move in conjunction with the piston 3 in a state where the one axial end side is in contact with the piston. In the embodiment, the shaft 4 is configured separately from the piston 3, and has a round-rod like portion (spline shaft which will be described later) 26, and a screw portion 27 which is integrally coupled to the round-rod like portion 26. The shaft 4 extends in the axial direction, and is placed coaxially with the housing 2 and the piston 3. The shaft 4 is made of, for example, quenched steel such as high carbon-chromium bearing steel. Alternatively, however, the round-rod like portion 26 may be made of stainless steel such as martensitic stainless steel.

The screw portion 27 is disposed in the one axial end portion (upper end portion) of the shaft 4, and an external thread is formed so that the screw portion can be screwed with the screw hole 23 of the piston 3. The shaft 4 is screwed to the piston 3 by screwing the screw portion 27 with the screw hole 23 of the piston 3, and the piston 3 can move in conjunction with the movement of the shaft 4.

Moreover, the driving device 6 has a motor section 30, and an output axle 31 which is placed coaxially with the shaft 4, and which is coupled to the other axial end side of the shaft 4. The driving device 6 is attached to the other axial end side (lower side) of the housing 2, and configured so that, in order to cause the piston 3 to reciprocally move in the axial direction (vertical direction) through the shaft 4, the driving device can convert rotational movement of the motor section 30 to linear movement, and output the linear movement from the output axle 31 to the shaft 4.

In the embodiment, the driving device 6 is configured by a linear actuator (motor), and can cause the piston 3 to reciprocally move in the axial direction between the most retracted position (see FIG. 1) where the piston 3 is closest in the housing 2, and the most advanced position (see FIG. 3) where the piston is remotest. The driving device 6 has a multi-phase stepping motor section which functions as the motor section 30, and a linear movement mechanism which can convert the rotational movement of the motor section 30 to linear movement, and which can output the linear movement.

The output axle 31 of the driving device 6 has a round-rod like portion 32 and a screw shaft portion 33 which is integrally connected to the round-rod like portion 32, and is included together with a screw nut 34 which is screwed with the screw shaft portion 33, in the linear movement mechanism. The output axle 31 is upwardly projected toward the interior of the cylinder 11 from an opposing surface which is on the main unit of the driving device 6, and which faces the interior of the cylinder 11. The output axle 31 is placed coaxially with the shaft 4, and a projection end portion (upper end portion) of the output axle, i.e., the round-rod like portion 32 is coupled to the other axial end portion (lower end portion) 28 of the shaft 4.

In the embodiment, the linear actuator has a configuration which is substantially identical with that of a conventional linear actuator, and therefore a detailed description of the other configuration of the linear actuator is omitted.

The rolling diaphragm 5 has: a lid portion 35 which is placed on the one axial side of the piston 3; an open-end portion 36 which is attached to the housing 2; and a folded portion 37 which is placed between the lid portion 35 and the open-end portion 35. The rolling diaphragm 5 is configured so that the lid portion 36 is reciprocally movable integrally with the piston 3 with respect to the open-end portion 36 which is positionally fixed by the housing 2.

In the embodiment, the rolling diaphragm 5 is made of a fluorine resin such as PTFE (polytetrafluoroethylene), and placed coaxially with the piston 3. The rolling diaphragm 5 is formed into a lidded cylindrical shape which is folded back to the outside in the other axial end side (lower side), and includes the disk-like lid portion 35 in an end portion on the one axial end side (upper side). The lid portion 35 has a diameter which is approximately equal to that of the piston 3, and is placed in a middle portion of the rolling diaphragm 5.

The rolling diaphragm 5 has an opening in the lower side, and, in the periphery of the opening, includes the folded portion 37 having a U-like sectional shape. A cylindrical inner cylinder portion 38 which extends in the axial direction is disposed between an inner circumferential end portion of the folded portion 37 and the lid portion 35, and a cylindrical outer cylinder portion 39 which extends coaxially with the inner cylinder portion 38 is disposed between the folded portion 37 and the open-end portion 36. The open-end portion 36 is disposed in the radially outer side of an upper end portion of the outer cylinder portion 39 so as to exhibit a flange-like shape.

In order to have flexibility, here, the inner cylinder portion 38, the folded portion 37, and the outer cylinder portion 39 are formed to have a small thickness (in a thin film-like shape) of, for example, 1 mm or smaller and 0.1 mm or larger. In order to have rigidity, the lid portion 35 and the open-end portion 36 are formed to be sufficiently thicker than the inner cylinder portion 38, the folded portion 37, and the outer cylinder portion 39.

In the rolling diaphragm 5, in a state where the diaphragm is accommodated in the housing 2, the open-end portion 36 is firmly clamped between the joining surfaces of the cylinder 11 and the pump head 12, whereby the open-end portion 36 is positionally fixed, and the diaphragm is then attached to the housing 2.

In order to allow the lid portion 35 to be butt-contacted to the piston 3, the rolling diaphragm 5 is disposed so that the lid portion 35 and the inner cylinder portion 38 cover the piston 3. The rolling diaphragm 5 is placed so as to be located between the inner circumferential surface of the housing 2 and the outer circumferential surface of the piston 3 in a state where the folded portion 37 faces a decompression chamber 53 which will be described later.

The guiding member 7 is placed in the other axial end side (lower side) of the interior of the housing 2 with respect to the piston 3, attached to the housing 2, and configured to be able to guide the shaft 4 in an axially movable manner. In the embodiment, the guiding member 7 functions as a bulkhead which partitions the interior of the housing 2, and the shaft 4 is allowed to pass through the guiding member. The guiding member 7 is formed into a planar shape having an outer circumferential surface which extends along the inner circumferential surface of the housing 2, and coupled in the outer circumferential surface to the inner circumferential surface of the housing 2 without any gap therebetween. The guiding member 7 is configured integrally with the cylinder 11.

The guiding member 7 is disposed in the housing 2 so that, when the piston 3 is moved to the most retracted position, the member butts against or substantially butts against the lower surface of the piston 3. The guiding member 7 is formed so that the shaft 4 is axially passed through the axial portion, and, while the one axial end portion (lower end portion) directly guides the shaft, the other portion can hold a cylindrical member 61 (described later) of the restricting mechanism 8.

In the diaphragm pump 1, the interior of the housing 2 is partitioned by the piston 3, the rolling diaphragm 5, the guiding member 7, and the like so that a pump chamber 51 which is to be filled with a liquid, a driving chamber 52, and the decompression chamber 53 are formed.

Specifically, the pump chamber 51 is defined by the rolling diaphragm 5 on the one axial end side (upper side) with respect to the rolling diaphragm 5 in the housing 2, and configured so that the volume of the interior of the chamber is changeable. In the embodiment, the pump chamber 51 is formed by being surrounded by the rolling diaphragm 5 and the pump head 12 of the housing 2, and communicates with each of the suction port 15 and the ejection port 16. In the pump chamber 51, the interior volume is changed by the operation (deformation) of the rolling diaphragm due to the reciprocal movement of the piston 3.

The driving chamber 52 is defined by the guiding member 7 on the other axial end side (lower side) with respect to the guiding member 7 in the housing 2. In the embodiment, the driving chamber 52 is formed by being surrounded by the guiding member 7, the cylinder 11 of the housing 2, and the driving device 6. Parts of the output axle 31 of the driving device 6 and the shaft 4 are accommodated in the driving chamber 52.

The decompression chamber 53 is defined in the housing 2 by the rolling diaphragm 5 and the piston 3 on the axially opposite side of the pump chamber 51 across the rolling diaphragm 5. In the embodiment, the decompression chamber 53 is formed by being surrounded by the piston 3 (the packing 19), the rolling diaphragm 5, and the housing (the cylinder 11), and communicates with the air vent 14.

The restricting mechanism 8 is disposed in the housing 2 between the guiding member 7 and the shaft 4, and configured so as to be able to restrict the rotation of the shaft 4 about the axis while allowing the reciprocal movement in the axial direction. In the embodiment, the restricting mechanism 8 is configured by a ball spline which allows a movable member to relatively move along an extended raceway.

Specifically, the restricting mechanism 8 has: a spline shaft (movable member) 60 configured by the shaft 4; and the cylindrical member (raceway member) 61 which is fixed to the guiding member 7, and which can guide the spline shaft 60 so as to be axially slidable while unrotatably supporting the spline shaft. The spline shaft 60 includes a plurality of raceway grooves 62 which extend in the axial direction, in the outer circumferential surface. The cylindrical member 61 includes other raceway grooves corresponding to the raceway grooves 62, and is held by the guiding member 7 in a state where the cylindrical member is unrotatably positioned by a bolt 63.

While passing through the guiding member 7, the spline shaft 60 is passed through the cylindrical member 61 a part of which is projected from the guiding member 7 toward the piston 3. In the raceway grooves of the cylindrical member 61, a plurality of balls are disposed so as to be located between the raceway grooves and the raceway grooves 62 of the spline shaft 60, and the spline shaft 60 is fitted in a relatively movable and relatively unrotatable manner to the cylindrical member 61 through the balls. In this way, the spline shaft 60 can move relative to the cylindrical member 61 without rattling.

In the above-described configuration, in the case where the driving device 6 is operated in order to drive the diaphragm pump 1, the output axle 31 linearly moves in the axial direction in accordance with rotation of the screw nut 34 to cause the shaft 4 to reciprocally move in the axial direction, with the result that the suction step in which the shaft 4 backwardly moves in the downward direction, and a discharge step in which the shaft 4 forwardly moves in the upward direction are repeatedly performed. Therefore, the liquid stored in the liquid tank can be supplied in a constant amount and at a constant flow rate to the liquid supplying section.

Figure 3:
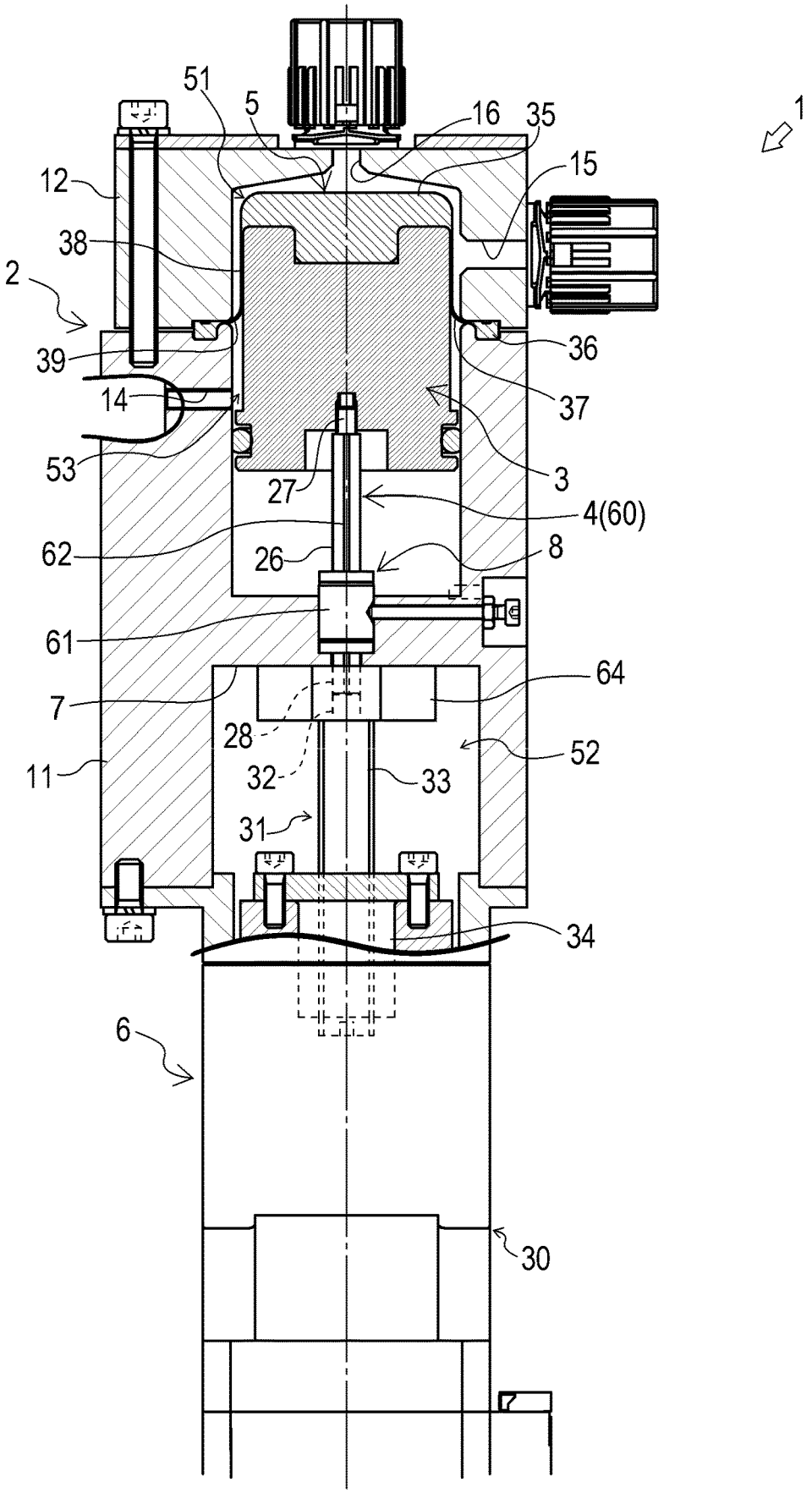
FIG. 3 is a side sectional view of the diaphragm pump of the first embodiment of the invention.

In the suction step, namely, the piston 3 and the lid portion 35 of the rolling diaphragm 5 backwardly move in the downward direction following the backward movement of the shaft 4 (the state shown in FIG. 3 is changed to that shown in FIG. 1). In this process, the rolling diaphragm 5 rolls so that the inner cylinder portion 38 in the axial direction is shortened, the outer cylinder portion 39 is lengthened, and the folded portion 37 rolls so as to be downwardly displaced in the gap between the inner circumferential surface of the housing 2 and the outer circumferential surface of the piston 3. In accordance with this, the volume of the pump chamber 51 is increased, and therefore the liquid in the liquid tank is sucked into the pump chamber 51 through the suction port 15.

In the discharge step, the piston 3 and the lid portion 35 of the rolling diaphragm 5 forwardly move in the upward direction following the forward movement of the shaft 4 (the state shown in FIG. 1 is changed to that shown in FIG. 3). In this process, the rolling diaphragm 5 rolls so that the inner cylinder portion 38 is lengthened, the outer cylinder portion 39 is shortened, and the folded portion 37 is upwardly displaced in the gap between the inner circumferential surface of the housing 2 and the outer circumferential surface of the piston 3. In accordance with this, the volume of the pump chamber 51 is decreased, and therefore the liquid in the pump chamber 51 is ejected from ejection port 16.

In the suction and discharge steps, the decompression chamber 53 is depressurized by the decompression device which is connected thereto through the air vent 14, so as to have a predetermined pressure (negative pressure). Therefore, the lower surface of the lid portion 35 of the rolling diaphragm 5, the inner surface of the inner cylinder portion 38, and the outer surface of the outer cylinder portion 39 can be surely closely contacted with the upper surface of the piston 3, the outer circumferential surface of the piston 3, and the inner circumferential surface of the housing 2, respectively.

In the suction and discharge steps, moreover, the shaft 4 reciprocally moves between the main unit of the driving device 6 in the housing 2 and the piston 3 while being guided by the guiding member 7. In this case, furthermore, the restricting mechanism 8 produces a state where the rotation of the shaft 4 about the axis is restricted while the reciprocal movement of the shaft 4 in the axial direction is allowed.

In the diaphragm pump 1, during the reciprocal movement of the shaft 4, therefore, the shaft 4 and the piston 3 which is moved in conjunction with the shaft are caused to hardly rattle in a radial direction (direction perpendicular to or intersecting with the axial direction) of the housing 2 (the cylinder 11 and the pump head 12), and the rolling diaphragm 5 is easily enabled to normally operate (deform) without causing the rolling diaphragm to twist or distort. Therefore, the lowering of the quantitativeness of the liquid transportation amount caused by the operation of the rolling diaphragm 5 can be effectively suppressed.

In the embodiment, particularly, the restricting mechanism 8 is configured by the ball spline having the spline shaft 60 which is formed by the shaft 4, and the cylindrical member 61, and therefore the shaft 4 smoothly reciprocally moves in the axial direction while being guided also by the cylindrical member 61. During the reciprocal movement of the shaft 4, consequently, the shaft 4 and the piston 3 are caused to further hardly rattle in a radial direction of the housing 2. Therefore, the lowering of the quantitativeness of the liquid transportation amount can be more effectively suppressed.

Figure 4:
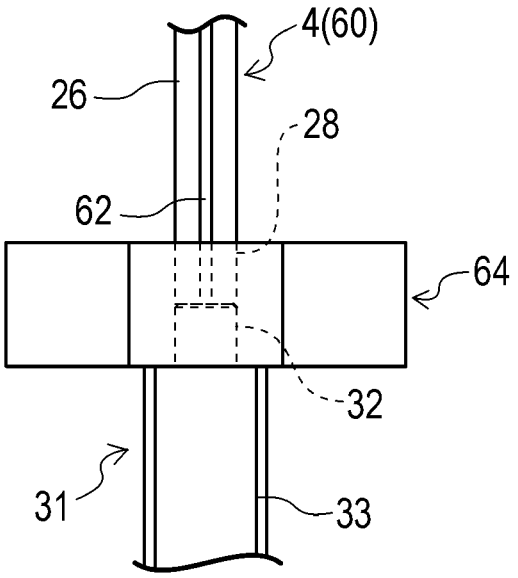
FIG. 4 is a view showing a coupling portion between a shaft and an output axle of a driving device in the diaphragm pump of the first embodiment of the invention, (a) is a side view, and (b) is a plan view.
Figure 4:
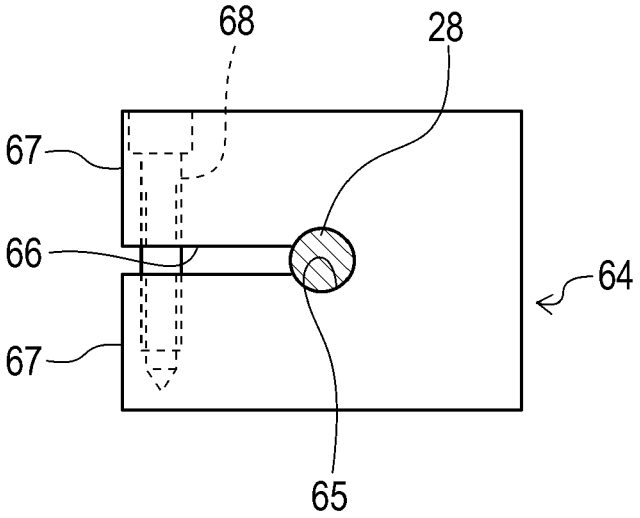

FIGS. 4(*a*) and (*b*) are side and plan views of a coupling portion between the shaft 4 and the output axle 31 of the driving device 6, respectively.

In the embodiment, as shown in FIGS. 4(*a*) and (*b*), the diaphragm pump 1 includes a coupling member 64. The coupling member 64 is configured so as to couple together the shaft 4 and the output axle 31 by clamping the other axial end portion (lower end portion) 28 of the shaft 4, and clamping the one axial end portion (upper end portion) of the output axle 31 of the driving device 6, i.e., the round-rod like portion 32.

Specifically, the coupling member 64 has: an attaching hole 65 into which the lower end portion 28 of the shaft 4 and the upper end portion (the round-rod like portion 32) of the output axle 31 are to be inserted and attached; a pair of fastening portions 67 that, between the portions, form a slit 66 through which the attaching hole 65 communicates with the outside, and that has a predetermined width; and a fastening member 68 such as a bolt which can fasten together the pair of fastening portions 67 so as to reduce the dimension of the gap between the pair of fastening portions 67 (the slit 66).

In the coupling member 64, the pair of fastening portions 67 are fastened together by the fastening member 68 in a state where the lower end portion 28 of the shaft 4 and the round-rod like portion 32 of the output axle 31 are inserted into the attaching hole 65 to be outer-fitted thereto without any substantial gap, whereby the lower end portion 28 of the shaft 4 and the round-rod like portion 32 of the output axle 31 are clamped to be coupled to each other.

According to the configuration, the shaft 4 and the output axle 31 of the driving device 6 can be easily assembled to and separated from each other. Therefore, maintenance of the diaphragm pump 1 can be simplified.

Although, in the embodiment, the output axle of the driving device is the output axle 31 which is coupled to the shaft 4 by using the coupling member 64, the output axle is not limited to this. For example, the output axle may be configured by an output axle that is coupled in a relatively rotatable manner to a shaft in which rotation is restricted by the function of the restricting mechanism.

In the embodiment, as described above, the piston 3 has the first concave portion 21 which opens toward the lid portion 35 of the rolling diaphragm 5. As shown in FIG. 2, the rolling diaphragm 5 has a projection 71 which is fittable into the first concave portion 21, and is attached to the piston 3 in a state where the projection 71 is fitted into the first concave portion 21 of the piston 3.

The projection 71 of the rolling diaphragm 5 is disposed so as to be downwardly projected from the axial portion of the lid portion 35, and placed coaxially with the first concave portion 21. The projection 71 has an outer circumferential surface which extends along the inner circumferential surface of the first concave portion 21, and is fitted into the first concave portion 21 without any substantial gap.

According to the configuration, in the case where a shock is applied to the liquid in the pump chamber 51 in, for example, the suction step of the diaphragm pump 1, it is possible to cause the rolling diaphragm 5 to hardly deform with respect to the piston 3. The axial alignment between the rolling diaphragm 5 and the piston 3 can be performed by fitting between the projection 71 and the first concave portion 21, and the lowering of the quantitativeness of the fluid transportation amount can be more effectively suppressed.

Next, a second embodiment of the invention will be described with reference to the drawings.

Figure 5:
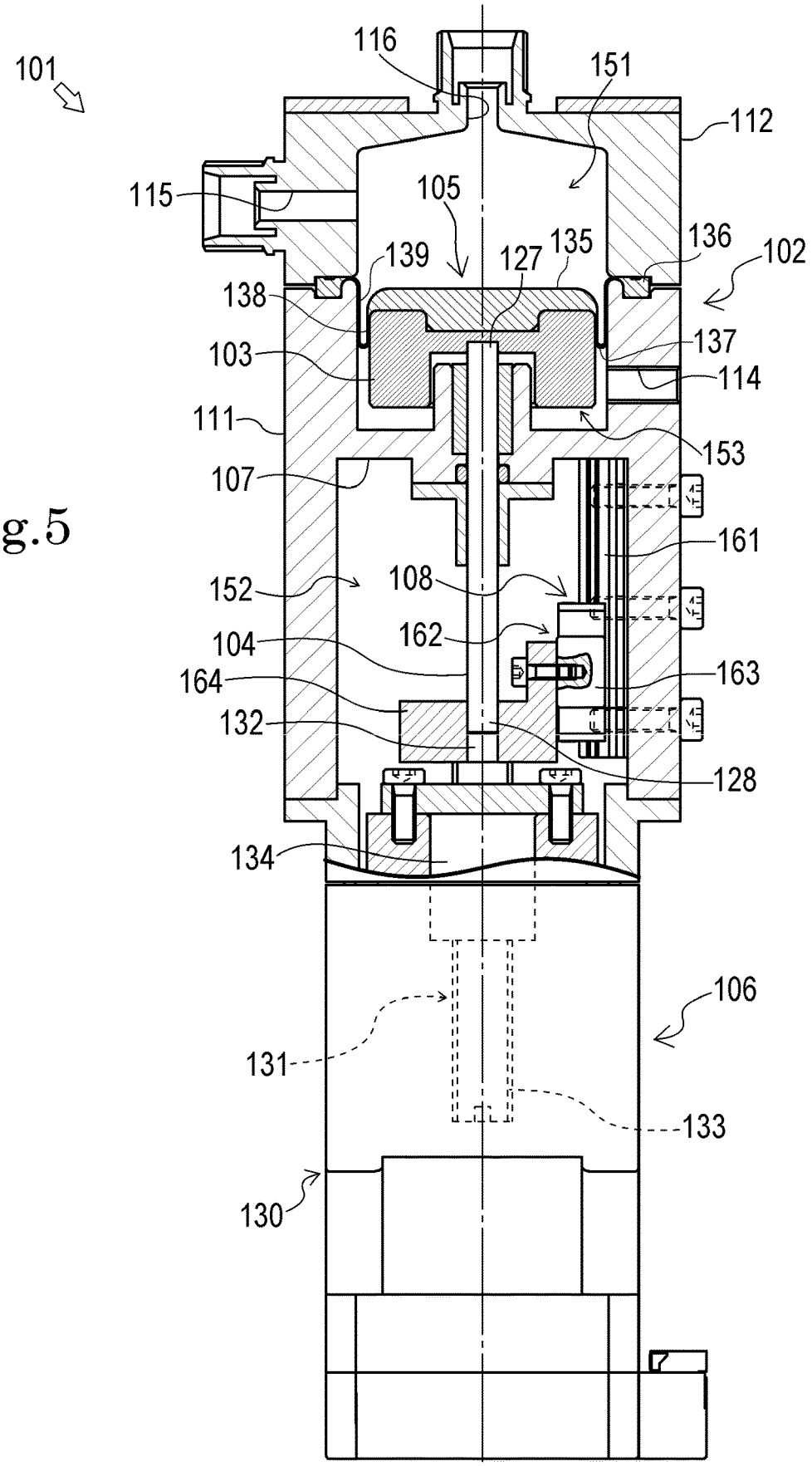
FIG. 5 is a side sectional view of a diaphragm pump of a second embodiment of the invention.
Figure 6:
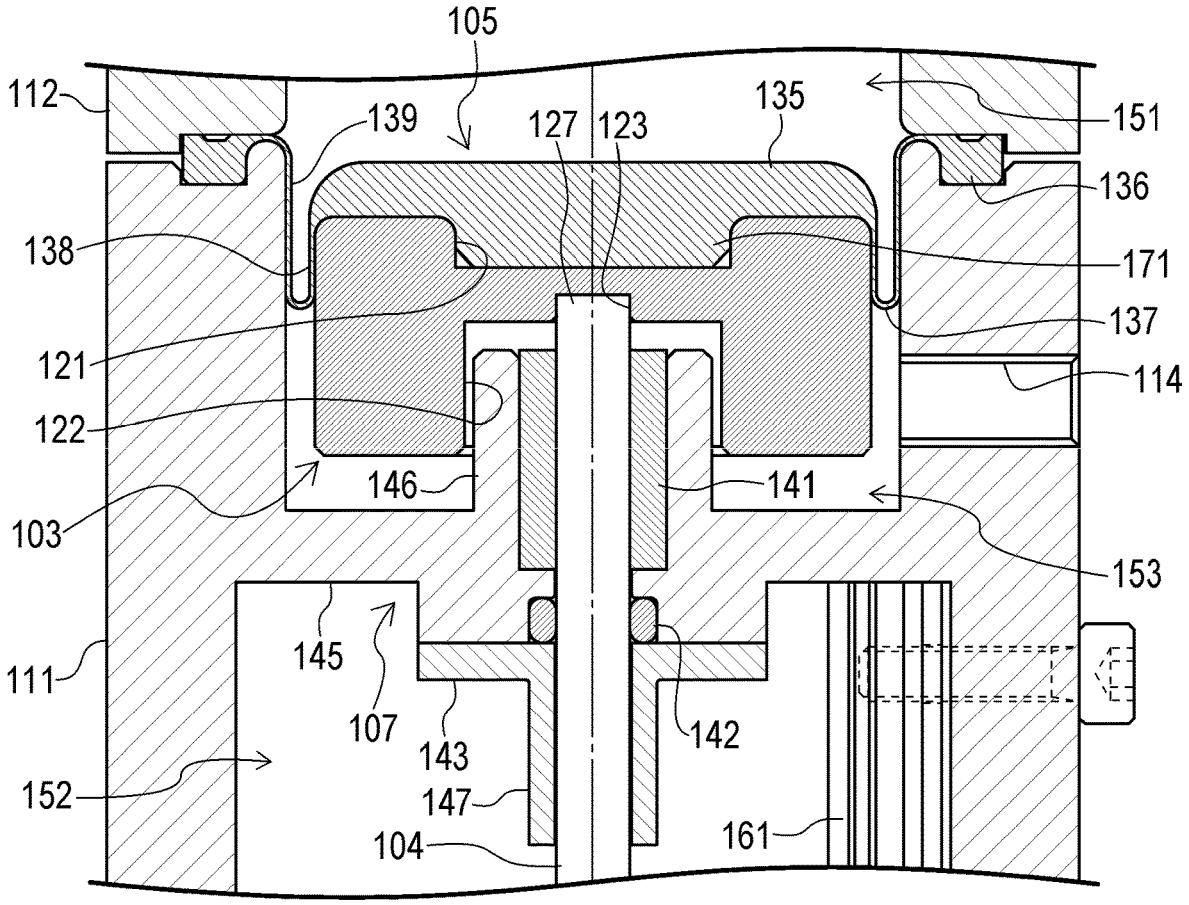
FIG. 6 is a partial enlarged side sectional view of the diaphragm pump of the second embodiment of the invention.
Figure 7:
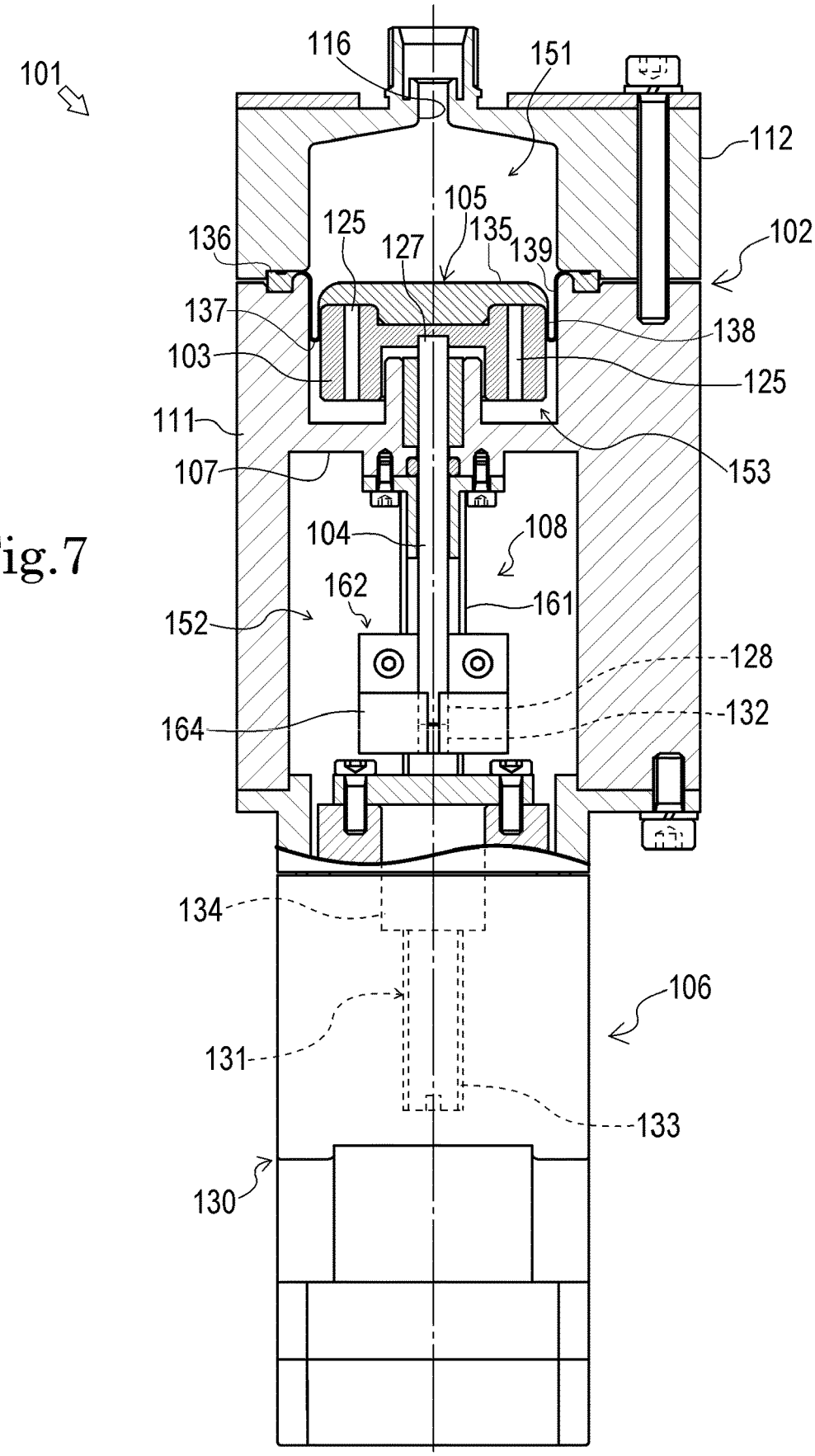
FIG. 7 is a front sectional view of the diaphragm pump of the second embodiment of the invention.

FIG. 5 is a side sectional view of a diaphragm pump 101 of the second embodiment of the invention. FIG. 6 is a partial enlarged side sectional view of the diaphragm pump 101. FIG. 7 is a front sectional view of the diaphragm pump 101.

As shown in FIGS. 5, 6, and 7, the diaphragm pump 101 includes a housing 102, a piston 103, a shaft 104, a rolling diaphragm 105, a driving device 106, a guiding member 107, and a restricting mechanism 108. In the embodiment, the diaphragm pump 101 is placed so that its longitudinal direction (axial direction) extends in the vertical direction.

In the embodiment, the housing 102 has a cylinder 111 and a pump head 112. The cylinder 111 is formed into a cylindrical shape, and placed so that the axial direction extends in the vertical direction. For example, the cylinder 111 is made of stainless steel such as SUS304. In the cylinder 111, an air vent 114 which passes through the cylinder in a direction intersecting with the axial direction is disposed. The air vent 114 is connected to a decompression device such as a vacuum pump or an aspirator.

The pump head 112 is formed into a lidded cylindrical shape, and attached to the one axial end side (upper side) of the cylinder 111 so as to close the opening. The pump head 112 has an inner diameter which is substantially equal to that of the cylinder 111, and constitutes together with the cylinder 111 an accommodating space which can accommodate the piston 103. The pump head 112 is made of a fluorine resin such as PTFE (polytetrafluoroethylene).

In a circumferential wall portion of the pump head 112, a suction port 115 which passes through the circumferential wall portion in a direction perpendicular to or intersecting with the axial direction is disposed. The suction port 115 is connected to a liquid tank (not shown) which stores a liquid such as a chemical liquid, through a suction check valve. The suction check valve is configured so as to allow the liquid to flow from the liquid tank toward the suction port 115, and block a liquid flow in the opposite direction.

In a lid portion of the pump head 112, an ejection port 116 which passes through the lid portion in the axial direction is disposed so as to be located in a middle portion (axial portion) of the lid portion. The ejection port 116 is connected to a liquid supplying section (not shown) through an ejection check valve. The ejection check valve is configured so as to allow the liquid to flow from the ejection port 116 to the liquid supplying section, and block a liquid flow in the opposite direction.

In the housing 102, the piston 103 is placed coaxially with the housing 102, and disposed so as to be reciprocally movable in the axial direction (vertical direction) of the housing 102. In the embodiment, the piston 103 is formed into a columnar shape having a diameter which is smaller then the inner diameter of the housing 102 (the cylinder 111 and the pump head 112), and placed so that the outer circumferential surface can be separated by a predetermined distance from the inner circumferential surface of the cylinder 111 or pump head 112 which is opposed to the piston. The piston 103 is made of, for example, an aluminum alloy.

As shown in FIG. 6, the piston 103 has a first concave portion 121 which opens toward the one axial end side (upper side), and a second concave portion 122 which opens toward the other axial end side (lower side). The first concave portion 121 and the second concave portion 122 are disposed in the axial portion of the piston 103, and placed coaxially with each other. Here, the first concave portion 121 and the second concave portion 122 do not communicate with each other.

The piston 103 further has a fitting concave portion 123 into which the one axial end portion of the shaft 104 is fittable. The fitting concave portion 123 is disposed between the first concave portion 121 and the second concave portion 122 and in the axial portion of the piston 103, and placed coaxially with the second concave portion 122. The fitting concave portion 123 is smaller in diameter than the second concave portion 122, and opens toward the other axial end side (lower side) of the piston 103 so as to face the interior of the second concave portion 122.

The piston 103 further has an air passage 125 configured by a linear through hole which is passed through the piston in the axial direction (see FIG. 7). The air passage 125 is disposed in plural numbers, and placed on the outer side of the first concave portion 121 and the second concave portion 122 with respect to a radial direction (direction perpendicular to the axial direction) of the piston 103, and at predetermined intervals on a circumference centered on the axis.

The shaft 104 is configured so as to move in conjunction with the piston 103 in a state where the one axial end side is in contact with the piston. In the embodiment, the shaft 104 is configured separately from the piston 103, and includes a one axial end portion (upper end portion) 127 having an outer circumferential surface which extends along the inner circumferential surface of the fitting concave portion 123. The shaft 104 has a diameter which is approximately equal to or slightly smaller than that of the fitting concave portion 123 of the piston 103, and is formed into a round-rod like shape. The shaft 104 extends in the axial direction, and is placed coaxially with the housing 102 and the piston 103. The shaft 104 is made of, for example, steel such as quenched high carbon-chromium bearing steel or stainless steel such as martensitic stainless steel.

In the embodiment, as described above, the piston 103 is configured so as to be movable in conjunction with the shaft 104 in the state where the one axial end side is contacted to the shaft 104, by fitting the upper end portion 127 of the shaft 104 into the fitting concave portion 123 while being separably contacted to each other. The shaft 104 is configured simply to be fitted from the lower side into the fitting concave portion 123 of the piston 103.

According to the configuration, the piston 103 and the shaft 104 can be easily assembled to and separated from each other. Therefore, maintenance of the diaphragm pump 101 can be simplified. Moreover, deformation of the piston 103 caused by the coupling of the piston 103 and the shaft 104 can be prevented from occurring.

Moreover, the driving device 106 has a motor section 130, and an output axle 131 which is placed coaxially with the shaft 104, and which is coupled to the other axial end side of the shaft 104. The driving device 106 is attached to the other axial end side (lower side) of the housing 102, and configured so that, in order to cause the piston 103 to reciprocally move in the axial direction (vertical direction) through the shaft 104, the driving device can convert rotational movement of the motor section 130 to linear movement, and output the linear movement from the output axle 131 to the shaft 104.

In the embodiment, the driving device 106 is configured by a linear actuator (motor), and can cause the piston 103 to reciprocally move in the axial direction between the most retracted position (see FIG. 5) where the piston 103 is closest in the housing 102, and the most advanced position (see FIG. 8) where the piston is remotest. The driving device 106 has a multi-phase stepping motor section which functions as the motor section 130, and a linear movement mechanism which can convert the rotational movement of the motor section 130 to linear movement, and which can output the linear movement.

The output axle 131 of the driving device 106 has a round-rod like portion 132 and a screw shaft portion 133 which is integrally connected to the round-rod like portion 132, and is included together with a screw nut 134 which is screwed with the screw shaft portion 133, in the linear movement mechanism. The output axle 131 is upwardly projected toward the interior of the cylinder 111 from an opposing surface which is on the main unit of the driving device 106, and which faces the interior of the cylinder 111. The output axle 131 is placed coaxially with the shaft 104, and a projection end portion (upper end portion) of the output axle, i.e., the round-rod like portion 132 is coupled to the other axial end portion (lower end portion) 128 of the shaft 104.

In the embodiment, the linear actuator has a configuration which is substantially identical with that of a conventional linear actuator, and therefore a detailed description of the other configuration of the linear actuator is omitted.

The rolling diaphragm 105 has: a lid portion 135 which is placed on the one axial side of the piston 103; an open-end portion 136 which is attached to the housing 102; and a folded portion 137 which is placed between the lid portion 135 and the open-end portion 136. The rolling diaphragm 105 is configured so that the lid portion 135 is reciprocally movable integrally with the piston 103 with respect to the open-end portion 136 which is positionally fixed by the housing 102.

In the embodiment, the rolling diaphragm 105 is made of a fluorine resin such as PTFE (polytetrafluoroethylene), and placed coaxially with the piston 103. The rolling diaphragm 105 is formed into a lidded cylindrical shape which is folded back to the outside in the other axial end side (lower side), and includes the disk-like lid portion 135 in an end portion of the one axial end side (upper side). The lid portion 135 has a diameter which is approximately equal to that of the piston 103, and is placed in a middle portion of the rolling diaphragm 105.

The rolling diaphragm 105 has an opening in the other axial end side (lower side), and, in the periphery of the opening, includes the folded portion 137 having a U-like sectional shape. A cylindrical inner cylinder portion 138 which extends in the axial direction is disposed between an inner circumferential end portion of the folded portion 137 and the lid portion 135, and a cylindrical outer cylinder portion 139 which extends coaxially with the inner cylinder portion 138 is disposed between the folded portion 137 and the open-end portion 136. The open-end portion 136 is disposed in the radially outer side of an upper end portion of the outer cylinder portion 139 so as to exhibit a flange-like shape.

In order to have flexibility, here, the inner cylinder portion 138, the folded portion 137, and the outer cylinder portion 139 are formed to have a small thickness (in a thin film-like shape) of, for example, 1 mm or smaller and 0.1 mm or larger. In order to have rigidity, the lid portion 135 and the open-end portion 136 are formed to be sufficiently thicker than the inner cylinder portion 138, the folded portion 137, and the outer cylinder portion 139.

In the rolling diaphragm 105, in a state where the diaphragm is accommodated in the housing 102, the open-end portion 136 is firmly clamped between the joining surfaces of the cylinder 111 and the pump head 112, whereby the open-end portion 136 is positionally fixed, and the diaphragm is then attached to the housing 102.

In order to allow the lid portion 135 to be butt-contacted to the piston 103, the rolling diaphragm 105 is disposed so that the lid portion 135 and the inner cylinder portion 138 cover the piston 103. The rolling diaphragm 105 is placed so as to be located between the inner circumferential surface of the housing 102 and the outer circumferential surface of the piston 103 in a state where the folded portion 137 faces a decompression chamber 153 which will be described later.

The guiding member 107 is placed in the other axial end side (lower side) of the interior of the housing 102 with respect to the piston 103, attached to the housing 102, and configured to be able to guide the shaft 104 in an axially movable manner. In the embodiment, the guiding member 107 functions as a bulkhead which partitions the interior of the housing 102. The guiding member 107 is formed into a planar shape having an outer circumferential surface which extends along the inner circumferential surface of the housing 102, and coupled in the outer circumferential surface to the inner circumferential surface of the cylinder 111 without any gap therebetween. The guiding member 107 is configured to guide the shaft 104 which is passed through the axial portion, and integrated with the cylinder 111.

The guiding member 107 is formed so that the shaft 104 is axially passed through the axial portion, and, while the other axial end side (lower side) directly guides the shaft, the one axial side (upper side) supports the shaft 104 through a bushing 141 which is disposed in the axial portion. The bushing 141 is made of, for example, carbon steel, stainless steel, brass, or a resin such as a fluorine resin or nylon. A packing 142 such as an O-ring is disposed between the guiding member 107 and the shaft 104. The packing 142 is made of, for example, a rubber material such as fluorine rubber. A packing gland member 143 is disposed below the guiding member 107 so as to be opposed to the packing 142. The packing gland member 143 is made of stainless steel such as SUS304.

The guiding member 107 is placed in the housing 102 and on the side of the piston 103, and has a guiding member body 145, and a boss portion 146 which is upwardly projected from an axial portion of the guiding member body 145. The boss portion 146 is formed so that, when the piston 103 moves to the most retracted position or a position proximal thereto, the boss portion can be fitted into the second concave portion 122 and movably guide the piston 103. In the embodiment, the bushing 141 extends in a range from the guiding member body 145 to the boss portion 146.

In the embodiment, moreover, a restricting member 147 is disposed on the side (below the guiding member 107) opposite to the boss portion 146 across the guiding member body 145. The restricting member 147 restricts upward slide movement of a sliding member 162 which will be described later. The restricting member 147 is made of, for example, stainless steel such as SUS304. Here, the restricting member 147 may be placed coaxially with the bushing 141, and disposed so as to support the shaft 104. The restricting member 147 may be configured integrally with the packing gland member 143.

In the diaphragm pump 101, the interior of the housing 102 is partitioned by the rolling diaphragm 105, the guiding member 107, and the like so that a pump chamber 151 which is to be filled with a liquid, a driving chamber 152, and the decompression chamber 153 are formed.

Specifically, the pump chamber 151 is defined by the rolling diaphragm 105 on the one axial end side (upper side) with respect to the rolling diaphragm 105 in the interior of the housing 102, and configured so that the volume of the chamber is changeable. In the embodiment, the pump chamber 151 is formed by being surrounded by the rolling diaphragm 105 and the pump head 112 of the housing 102, and communicates with each of the suction port 115 and the ejection port 116. In the pump chamber 151, the interior volume is changed by the operation (deformation) of the rolling diaphragm due to the reciprocal movement of the piston 103.

The driving chamber 152 is defined by the guiding member 107 on the other axial end side (lower side) with respect to the guiding member 107 in the housing 102. In the embodiment, the driving chamber 152 is formed by being surrounded by the guiding member 107, the cylinder 111 of the housing 102, and the driving device 106. Parts of the output axle 131 of the driving device 106 and the shaft 104 are accommodated in the driving chamber 152.

The decompression chamber 153 is defined in the housing 102 and between the pump chamber 151 and the driving chamber 152 by the piston 103, the rolling diaphragm 105, and the guiding member 107. In the embodiment, the decompression chamber 153 is formed by being surrounded by the piston 103, the rolling diaphragm 105, the guiding member 107, and the cylinder 111 of the housing 102, and communicates with the air vent 114.

During driving of the diaphragm pump 101, the decompression chamber 153 is depressurized by the decompression device which is connected thereto through the air vent 114, so as to have a predetermined pressure (negative pressure). The decompression chamber 153 communicates with the space between the upper surface of the piston 103 and lower surface of the lid portion 135 of the rolling diaphragm 105 which are butt-contacted to each other, through the plurality of air vents 125 disposed in the piston 103.

The restricting mechanism 108 is disposed in the housing 102 on the side of the other axial side with respect to the guiding member 107, and between the housing 102 and the shaft 104, and configured so as to be able to restrict the rotation of the shaft 104 about the axis while allowing the reciprocal movement in the axial direction. In the embodiment, the restricting mechanism 108 is configured by a linear guide which is disposed in the driving chamber 152, and which allows a movable member to relatively move along an extended raceway.

Specifically, the restricting mechanism 108 has a rail-like guiding member (raceway member) 161 which is disposed in the housing 102 so as to extend in the axial direction to face the interior of the driving chamber, and a sliding member (movable member) 162 which is fixed to the shaft 104, which is attached to the guiding member 161, and which is relatively movable with respect to the guiding member 161. The sliding member 162 includes a plurality of balls (rolling elements) in the member, and is fitted to the guiding member 161 through the balls in a relatively movable manner. In this way, the sliding member 162 can slidingly move relative to the guiding member 161 without rattling.

The sliding member 162 has a sliding portion 163 and a coupling member 164 which is fixed to the sliding portion 163. The sliding portion 163 is attached to the guiding member 161 in such a manner that the portion straddles the member from the side of the axis of the housing 102, and slidingly movable in the axial direction while being guided by the guiding member 161. The coupling member 164 is fitted onto the shaft 104, and fixed thereto so as to be movable integrally therewith in accordance with the reciprocal movement of the shaft 104. In the upward movement of the coupling member 164, when the member bumps against the restricting member 147, the upward movement of the whole sliding member 162 is restricted (see FIG. 8).

In the above-described configuration, in the case where the driving device 106 is operated in order to drive the diaphragm pump 101, the output axle 131 linearly moves in the axial direction in accordance with rotation of the screw nut 134 to cause the shaft 104 to reciprocally move in the axial direction, with the result that the suction step in which the shaft 104 backwardly moves in the downward direction, and a discharge step in which the shaft 104 forwardly moves in the upward direction are repeatedly performed. Therefore, the liquid stored in the liquid tank can be supplied in a constant amount and at a constant flow rate to the liquid supplying section.

Figure 8:
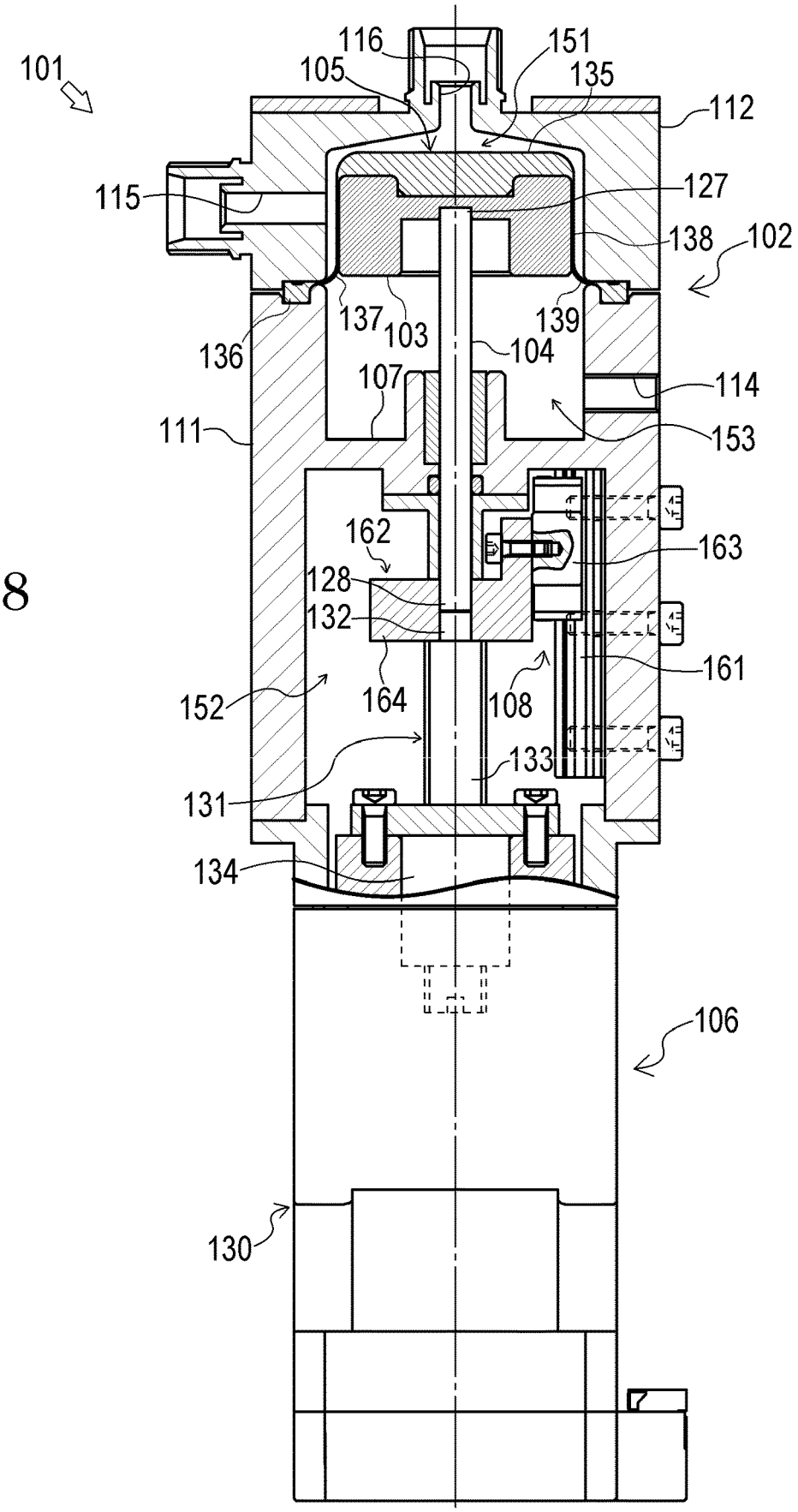
FIG. 8 is a side sectional view of the diaphragm pump of the second embodiment of the invention.

In the suction step, namely, the piston 103 and the lid portion 135 of the rolling diaphragm 105 backwardly move in the downward direction following the backward movement of the shaft 104 (the state shown in FIG. 8 is changed to that shown in FIG. 5). In this process, the rolling diaphragm 105 rolls so that the inner cylinder portion 138 in the axial direction is shortened, the outer cylinder portion 139 is lengthened, and the folded portion 137 is downwardly displaced in the gap between the inner circumferential surface of the housing 102 and the outer circumferential surface of the piston 103. In accordance with this, the volume of the pump chamber 151 is increased, and therefore the liquid in the liquid tank is sucked into the pump chamber 151 through the suction port 115.

In the discharge step, the piston 103 and the lid portion 135 of the rolling diaphragm 105 forwardly move in the upward direction following the forward movement of the shaft 104 (the state shown in FIG. 5 is changed to that shown in FIG. 8). In this process, the rolling diaphragm 105 rolls so that the inner cylinder portion 138 is lengthened, the outer cylinder portion 139 is shortened, and the folded portion 137 is upwardly displaced in the gap between the inner circumferential surface of the housing 102 and the outer circumferential surface of the piston 103. In accordance with this, the volume of the pump chamber 151 is decreased, and therefore the liquid in the pump chamber 151 is ejected from ejection port 116.

In the suction and discharge steps, the decompression chamber 153 is depressurized by the decompression device which is connected thereto through the air vent 114, so as to have a predetermined pressure (negative pressure). Therefore, the lower surface of the lid portion 135 of the rolling diaphragm 105, the inner surface of the inner cylinder portion 138, and the outer surface of the outer cylinder portion 139 can be surely closely contacted with the upper surface of the piston 103, the outer circumferential surface of the piston 103, and the inner circumferential surface of the housing 102, respectively.

Particularly, the space between the lower surface of the lid portion 135 of the rolling diaphragm 105 and upper surface of the piston 103 which are butt-contacted to each other is communicated with the decompression chamber 153 by the plurality of the air passages 125 disposed in the piston 103. Therefore, the lid portion 135 of the rolling diaphragm 105 and the piston 103 can be further surely closely contacted with each other.

In the suction and discharge steps, moreover, the shaft 104 reciprocally moves between the main unit of the driving device 106 in the housing 102 and the piston 103, particularly at a position close to the piston 103 while being guided by the guiding member 107. In this case, furthermore, the restricting mechanism 108 produces a state where the rotation of the shaft 104 about the axis is restricted while the reciprocal movement of the shaft 104 in the axial direction is allowed.

In the diaphragm pump 101, during the reciprocal movement of the shaft 104, therefore, the shaft 104 and the piston 103 which is moved in conjunction with the shaft are caused to hardly rattle in a radial direction (direction perpendicular to or intersecting with the axial direction) of the housing 102 (the cylinder 111 and the pump head 112), and the rolling diaphragm 105 is easily enabled to normally operate (deform) without causing the rolling diaphragm to twist or distort. Therefore, the lowering of the quantitativeness of the liquid transportation amount caused by the operation of the rolling diaphragm 105 can be effectively suppressed.

In the embodiment, particularly, the restricting mechanism 108 is configured by the linear guide having the guiding member 161 and the sliding member 162, and therefore the shaft 104 smoothly reciprocally moves in the axial direction while being guided also by the guiding member 161, by using the sliding movement of the sliding member 162. During the reciprocal movement of the shaft 104, consequently, the shaft 104 and the piston 103 can be caused to further hardly rattle in a radial direction of the housing 102. Therefore, the lowering of the quantitativeness of the liquid transportation amount can be more effectively suppressed.

Figure 9:
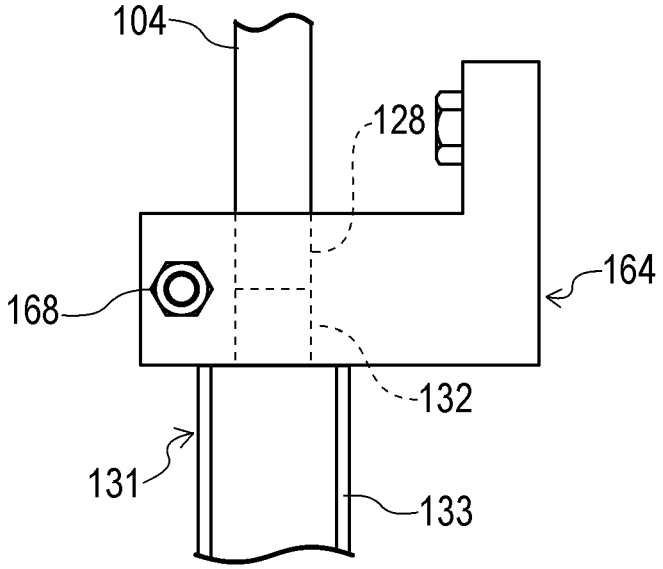
FIG. 9 is a view showing a coupling portion between a shaft and an output axle of a driving device in the diaphragm pump of the second embodiment of the invention, (a) is a side view, and (b) is a plan view.
Figure 9:
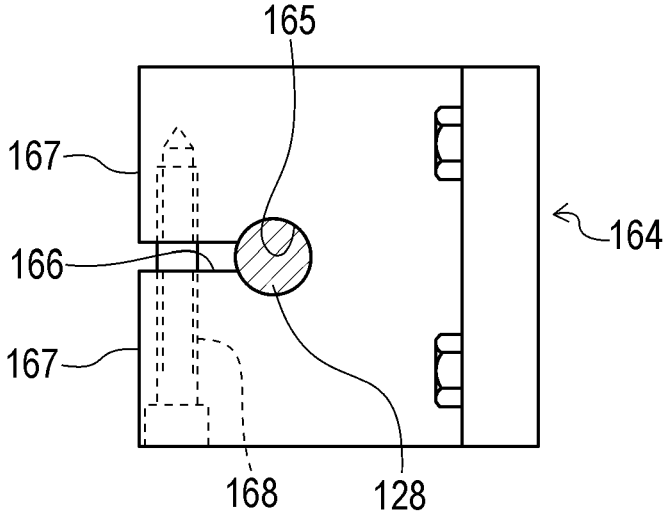

FIGS. 9(*a*) and (*b*) are side and plan views of a coupling portion between the shaft 104 and the output axle 131 of the driving device 106, respectively.

In the embodiment, as shown in FIGS. 9(*a*) and (*b*), the sliding member 162 of the restricting mechanism 108 is configured so as to couple together the shaft 104 and the output axle 131 by clamping the other axial end portion (lower end portion) 128 of the shaft 104, and clamping the one axial end portion (upper end portion) of the output axle 131, i.e., the round-rod like portion 132.

Specifically, the coupling member 164 has: an attaching hole 165 into which the lower end portion 128 of the shaft 104 and the upper end portion (the round-rod like portion 132) of the output axle 131 are to be inserted and attached; a pair of fastening portions 167 that, between the portions, form a slit 166 through which the attaching hole 165 communicates with the outside, and that has a predetermined width; and a fastening member 168 such as a bolt which can fasten together the pair of fastening portions 167 so as to reduce the dimension of the gap between the pair of fastening portions 167 (the slit 166).

In the coupling member 164, the pair of fastening portions 167 are fastened together by the fastening member 168 in a state where the lower end portion 128 of the shaft 104 and the round-rod like portion 132 of the output axle 131 are inserted into the attaching hole 165 to be outer-fitted thereto without any substantial gap, whereby the lower end portion 128 of the shaft 104 and the round-rod like portion 132 of the output axle 131 are clamped to be coupled to each other.

According to the configuration, the shaft 104 and the output axle 131 of the driving device 106 can be easily assembled to and separated from each other. Therefore, maintenance of the diaphragm pump 101 can be simplified. Moreover, the shaft 104 and the output axle 131 can be axially moved while maintaining the stable connection state.

Although, in the embodiment, the output axle of the driving device is the output axle 131 which is coupled to the shaft 104 by using the sliding member 162 (the coupling member 164) of the restricting mechanism 108, the output axle is not limited to this. For example, the output axle may be configured by an output axle that is coupled in a relatively rotatable manner to a shaft in which rotation is restricted by the function of the restricting mechanism.

In the embodiment, as described above, the piston 103 has the first concave portion 121 which opens toward the lid portion 135 of the rolling diaphragm 105. As shown in FIG. 6, the rolling diaphragm 105 has a projection 171 which is fittable into the first concave portion 121, and is attached to the piston 103 in a state where the projection 171 is fitted into the first concave portion 121 of the piston 103.

The projection 171 of the rolling diaphragm 105 is disposed so as to be downwardly projected from the axial portion of the lid portion 135, and placed coaxially with the first concave portion 121. The projection 171 has an outer circumferential surface which extends along the inner circumferential surface of the first concave portion 121, and is fitted into the first concave portion 121 without any substantial gap. The first concave portion 121 is formed to be shallower (so that the width in the axial direction is smaller) than the second concave portion 122.

According to the configuration, in the case where a shock is applied to the liquid in the pump chamber 151 in, for example, the suction step of the diaphragm pump 101, it is possible to cause the rolling diaphragm 105 to hardly deform with respect to the piston 103. The axial alignment between the rolling diaphragm 105 and the piston 103 can be performed by fitting between the projection 171 and the first concave portion 121, and the lowering of the quantitativeness of the fluid transportation amount can be more effectively suppressed.

DESCRIPTION OF REFERENCE NUMERALS

1 diaphragm pump
2 housing
3 piston
4 shaft
5 rolling diaphragm
6 driving device
7 guiding member
8 restricting mechanism
21 concave portion (first concave portion)
28 other axial end portion of shaft
30 motor section
31 output axle
32 one axial end portion of output axle (round-rod like portion)
35 lid portion
36 open-end portion
37 folded portion
51 pump chamber
52 driving chamber
53 decompression chamber
60 spline shaft
61 cylindrical member
71 projection
101 diaphragm pump
102 housing
103 piston
104 shaft
105 rolling diaphragm
106 driving device
107 guiding member
108 restricting mechanism
121 concave portion (first concave portion)
123 fitting concave portion
127 one axial end portion of shaft
128 other axial end portion of shaft
130 motor section
131 output axle
132 one axial end portion of output axle (round-rod like portion)
135 lid portion
136 open-end portion
137 folded portion
151 pump chamber
152 driving chamber
153 decompression chamber
161 guiding member
162 sliding member
171 projection

The invention claimed is:

1. A diaphragm pump including:

a housing;

a piston which is placed in the housing to be coaxial with the housing, and which is disposed to be reciprocally movable in an axial direction of the housing;

a shaft which is configured to be moved in conjunction with the piston in a state where one axial end side of the shaft is in contact with the piston;

a rolling diaphragm having: a lid portion which is placed on one axial end side of the piston; an open-end portion which is attached to the housing; and a folded portion which is placed between the lid portion and the open-end portion, the lid portion being reciprocally movable integrally with the piston with respect to the open-end portion which is positionally fixed by the housing;

a pump chamber which is defined by the rolling diaphragm on one axial side in the housing, a volume of an interior of the chamber being variable;

a driving device having: a motor section; and an output axle which is placed coaxially with the shaft, and which is coupled to another axial end side of the shaft, the driving device being attached to an other side in the axial direction of the housing, the driving device being able to, in order to cause the piston to reciprocally move in the axial direction of the housing through the shaft, convert rotational movement of the motor section to linear movement, and output the linear movement from the output axle to the shaft;

a guiding member which is placed on the other side in the axial direction of the housing with respect to the piston in the housing, and which is attached to the housing in a manner to extend in a direction perpendicular to the axial direction of the housing, and which is able to guide the shaft in a manner to be movable in the axial direction in a state where the shaft is passed through the guiding member in the axial direction of the housing; and a restricting mechanism which is disposed in the housing and between the output axle of the driving device and the shaft, and which is able to restrict rotation of the shaft about an axis of the housing while allowing reciprocal movement in the axial direction of the housing, wherein:

the output axle of the driving device has a rod-like portion at one axial end side and a screw shaft portion at another axial end side, and the screw shaft portion is integrally connected to the rod-like portion;

the restricting mechanism includes a coupling member that couples the shaft to the rod-like portion of the output axle of the driving device by clamping the other axial end side of the shaft and the rod-like portion of the output axle such that the other axial end side of the shaft faces the rod-like portion of the output axle;

the piston includes a concave portion that opens toward the other axial end side of the housing;

the guiding member includes a boss portion that is projected toward the one axial end side of the housing to support the shaft and guide the shaft toward the axial direction of the housing; and, the boss portion enters the concave portion of the piston when the piston moves toward the most retracted position, and the boss portion gets out of the concave portion when the piston moves toward the most advanced position.

2. The diaphragm pump according to claim 1, wherein the restricting mechanism is configured by a ball spline having: a spline shaft which is formed by the shaft; and a cylindrical member which is fixed to the guiding member, and which is able to slidably guide the spline shaft in the axial direction while supporting the spline shaft in a relatively non-rotatable manner.

3. The diaphragm pump according to claim 2, wherein
the piston has an other concave portion that opens toward the lid portion of the rolling diaphragm, and
the rolling diaphragm has a projection that is fittable into the other concave portion of the piston, and is attached to the piston in a state where the projection is fitted into the other concave portion of the piston.

4. The diaphragm pump according to claim 3, wherein the piston is disposed on the one side in the axial direction of the housing with respect to the guiding member in the housing, and the restricting mechanism is disposed on the other side in the axial direction of the housing with respect to the guiding member in the housing.

5. The diaphragm pump according to claim 4, wherein
the restricting mechanism is configured by
a linear guide having: a rail-like guiding member which is disposed in the housing to extend in the axial direction; and a sliding member which is fixed to the shaft, which is attached to the rail-like guiding member, and which is relatively movable with respect to the rail-like guiding member.

6. The diaphragm pump according to claim 5, wherein the sliding member is configured to couple the shaft and the output axle with each other by clamping the other axial end portion of the shaft, and clamping the one axial end portion of the output axle.

7. The diaphragm pump according to claim 1, wherein
the piston has an other concave portion which opens toward the lid portion of the rolling diaphragm, and
the rolling diaphragm has a projection which is fittable into the other concave portion of the piston, and is attached to the piston in a state where the projection is fitted into the other concave portion of the piston.

8. The diaphragm pump according to claim 1, wherein the piston is disposed on the one side in the axial direction of the housing with respect to the guiding member in the housing, and the restricting mechanism is disposed on the other side in the axial direction of the housing with respect to the guiding member in the housing.

9. The diaphragm pump according to claim 8, wherein
the restricting mechanism is configured by a linear guide having: a rail-like guiding member which is disposed in the housing to extend in the axial direction; and a sliding member which is fixed to the shaft, which is attached to the rail-like guiding member, and which is relatively movable with respect to the rail-like guiding member.

10. The diaphragm pump according to claim 9, wherein the coupling member is built in the sliding member.

11. The diaphragm pump according to claim 10, wherein the one axial end portion of the shaft is fittable into the concave portion of the piston, and the piston is configured to be movable in conjunction with the shaft, by fitting the one axial end portion of the shaft into the fitting concave portion while being separably contacted to each other.

12. The diaphragm pump according to claim 9, wherein the one axial end portion of the shaft is fittable into the concave portion of the piston, and the piston is configured to be movable in conjunction with the shaft, by fitting the one axial end portion of the shaft into the fitting concave portion while being separably contacted to each other.

13. The diaphragm pump according to claim 8, wherein the one axial end portion of the shaft is fittable into the concave portion of the piston, and the piston is configured to be movable in conjunction with the shaft, by fitting the one axial end portion of the shaft into the fitting concave portion while being separably contacted to each other.

14. The diaphragm pump according to claim 13, wherein
the piston has an other concave portion that opens toward the lid portion of the rolling diaphragm, and
the rolling diaphragm has a projection that is fittable into the other concave portion of the piston, and is attached to the piston in a state where the projection is fitted into the other concave portion of the piston.

15. The diaphragm pump according to claim 8, wherein
the piston has an other concave portion that opens toward the lid portion of the rolling diaphragm, and
the rolling diaphragm has a projection that is fittable into the other concave portion of the piston, and is attached to the piston in a state where the projection is fitted into the other concave portion of the piston.

* * * * *